US005780766A

United States Patent [19]

Schröppel

[11] Patent Number: 5,780,766

[45] Date of Patent: Jul. 14, 1998

[54] GUIDED MISSILE DEPLOYABLE AS MORTAR PROJECTILE

[75] Inventor: Werner Schröppel, Wendelstein, Germany

[73] Assignee: Diehl GmbH & Co., Nuremberg, Germany

[21] Appl. No.: 832,557

[22] Filed: Apr. 2, 1997

[30] Foreign Application Priority Data

Apr. 30, 1996 [DE] Germany ..... 196 17 221.7

[51] Int. Cl.[6] ..... F42B 12/18; F42B 15/00

[52] U.S. Cl. ..... 102/372; 102/308; 102/476; 244/3.27

[58] Field of Search ..... 102/308, 372, 102/373, 374, 476; 244/3.1, 3.15, 3.16, 3.21, 3.24, 3.27, 3.28, 3.29

[56] References Cited

U.S. PATENT DOCUMENTS

| | | | |
|---|---|---|---|
| 3,072,055 | 1/1963 | Ross | 102/476 |
| 3,282,540 | 11/1966 | Lipinski | 244/3.16 |
| 4,522,356 | 6/1985 | Lair et al. . | |
| 4,533,094 | 8/1985 | Geis et al. | 244/3.24 |
| 4,660,786 | 4/1987 | Brieseck et al. . | |
| 4,664,339 | 5/1987 | Crossfield . | |
| 4,823,700 | 4/1989 | Alker et al. | 102/476 |
| 4,974,516 | 12/1990 | Eyal | 102/476 |
| 5,040,745 | 8/1991 | Oswald et al. . | |
| 5,107,766 | 4/1992 | Schliesske et al. | 102/373 |
| 5,123,612 | 6/1992 | Labroche et al. | 102/476 |
| 5,565,648 | 10/1996 | Lundstadt et al. | 102/476 |

FOREIGN PATENT DOCUMENTS

| | | | |
|---|---|---|---|
| E 44 315 | 6/1989 | Austria . | |
| 0 249 678 | 12/1987 | European Pat. Off. . | |
| 0 201 433 | 8/1988 | European Pat. Off. . | |
| 0 583 642 B1 | 2/1994 | European Pat. Off. . | |
| 2603375 | 3/1988 | France | 102/476 |
| 3540021 | 5/1987 | Germany | 102/476 |
| 39 41 445 A1 | 6/1991 | Germany . | |

OTHER PUBLICATIONS

Schroder, Hans–Jurgen, "Experimentalgeschoss BUSSARD Technologie–Studie zur Endphasenlenkung von Geschossen", Diehl–Berichte wehrtn. Entw. 1982, pp. 48–52.

*Primary Examiner*—Harold J. Tudor

*Attorney, Agent, or Firm*—Scully, Scott, Murphy & Presser

[57] ABSTRACT

A guided missile which can be fired as a mortar projectile with armour-piercing hollow-charge warhead behind a seeking head for autonomous or semi-autonomous final phase guidance is to be capable of use for universal use from the same mortar weapon selectively against hard-armoured targets and against concreted protective constructions. For that purpose provided in front of the blast-forming main hollow charge is a boring hollow charge which is also blast-forming but slower and of higher mass and which, in the event of impact against a target, clears in a region-wise manner the reactive additional armouring of an armoured vehicle or penetrates the concrete wall of a protection arrangement. Upon impact against the target, a sub-calibre post-firing fragmentation explosive charge is released due to inertia from its holder in order to detonate after passing through the hole in the concrete wall therebehind or in the event of impact against a hard target to produce secondary effects against sensor elements. The post-firing charge can be held behind the main hollow charge. If the space between the two hollow charges is not required for receiving folding vanes during launching of the projectile from a mortar tube, the post-firing charge can also be arranged in front of the main hollow charge in order to reduce the distance to the hole in the concrete wall and thereby to increase the reliability in terms of entry into same.

7 Claims, 2 Drawing Sheets

GUIDED MISSILE DEPLOYABLE AS MORTAR PROJECTILE

BACKGROUND OF THE INVENTION

1. Field of the Invention

Figure 1:
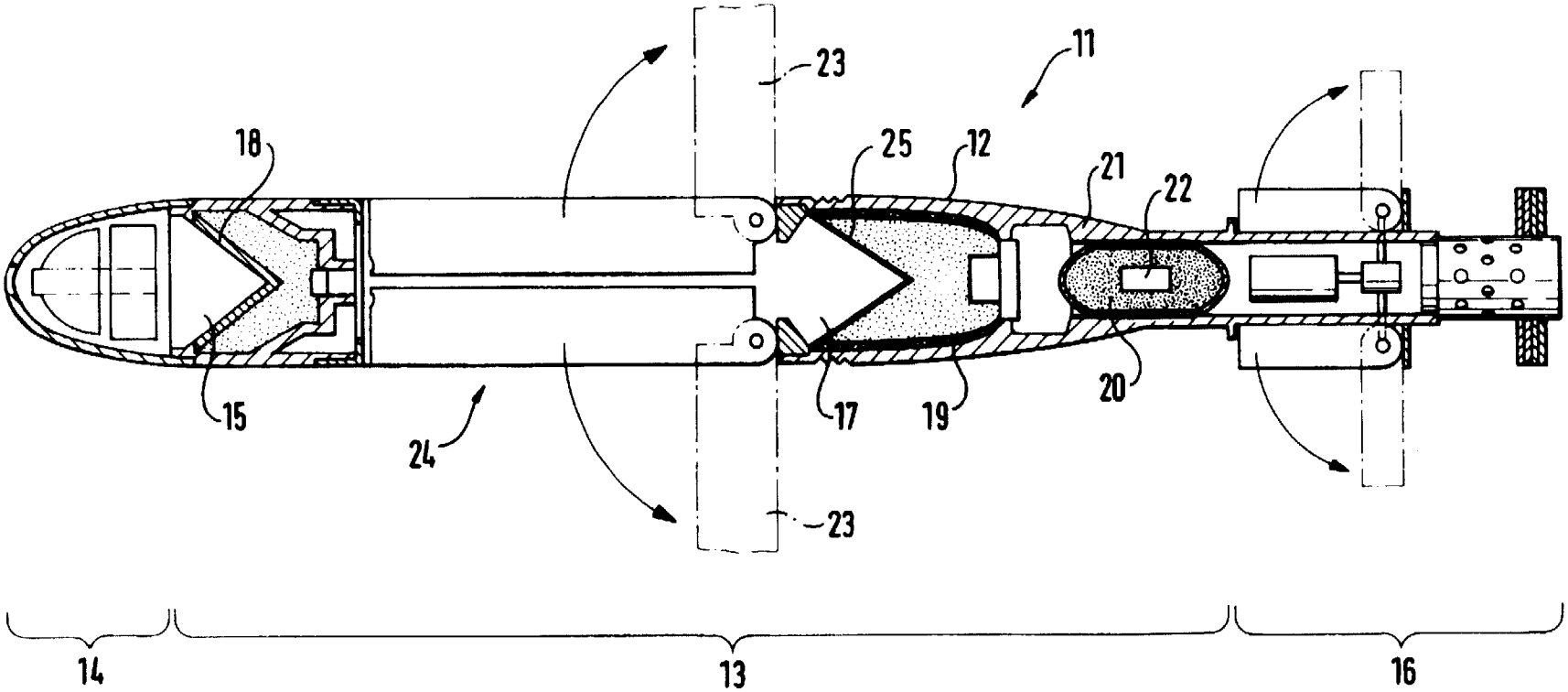

The present invention relates to a guided missile which is deployable as a mortar projectile, including an armor-piercing warhead, such as a main hollow charge, located rearwardly of a seeking head.

2. Description of the Prior Art

A guided missile of that kind is known as the system BUSSARD for the semi-autonomous attack on a hard-armoured target object by means of an armorpiercing pointed cone hollow charge located behind the seeking head for control in relation to the object marked by a target pathfinder, see FIG. 7 in H–J Schröder 'Experimentalgeschoss Bussard, Technologie-Studie zur Endphasenlenkung von Geschossen' in 'DIEHL-Berichte aus der wehrtechnischen Entwicklung', 1982, pages 48 ff, 50 top left. However, the effect of such a hollow charge warhead is slight if the operative blast is disturbed by reactive auxiliary armoring, as is increasingly encountered for the protection of battle armor. Therefore modern armor-piercing tubular ammunition has a tandem arrangement comprising a small precursor hollow charge which is arranged in coaxial or eccentric relationship with respect to the main hollow charge disposed therebehind; in that case, both blast-forming inserts (hollow cone) and also projectile-forming inserts (hollow ball caps) are known for use in such tandem warheads, referring to EP patent specification No 0 201 433 or laid-open European patent application No 0 249 678.

Attempts to use armor-piercing hollow charge warheads against protective arrangements such as, in particular, concrete bunkers have proven to be not very promising, irrespective of whether the concrete structure is concealed by an axially damping and radially damming layer of earth or even when openly accessible. Even inertia projectiles of any design, when using normal steep-trajectory weapon kinematics, do not promise lasting success against protected locations under hardened fortifications. A projectile which is guided in the final phase, in the manner of the BUSSARD which is fired from the mortar weapon (or a derivative with a tandem warhead against reactively armored hard targets) is therefore not able to be used with a prospect of success against an enemy who can govern a large field of fire from a bunker concealment. That, however, is the situation with which crisis reaction forces are frequently confronted, especially in a combat exchange with armored vehicles (operating between the fortified locations). For that reason there is a current need, which is becoming ever more urgent, for the development of multi-purpose ammunition which can be fired from the tried and tested mortar weapon, for use in those two main scenarios.

For house-to-house fighting, there has been developed a weapon GRABAS, described in accordance with European patent specification No 0 583 642, which is to be handled in a comparable manner to a bazooka and whose warhead, on hitting a wall, fires a flat boring hollow charge for piercing the wall by means of a compact high-mass blast. Upon deceleration of the warhead, due to the impact, a sub-caliber, post-firing or second-shot charge which is disposed behind the hollow charge is then also released from its holder and flies into the hole which has been torn open by the boring charge, in order to fire its explosive and fragmentation warhead with a time dealy, namely only after having passed into the space behind the wall. By means of a Janus arrangement, as described in accordance with German laid-open application (DE-OS) No 39 41 445 it is possible to ensure that the post-firing charge also acts rearwardly and thus directly in the region behind the pierced wall. Such a system, however, does not have any effect against armored targets, or at most, the boring charge results in local clearing of reactive additional armoring located over the main armoring.

SUMMARY OF THE INVENTION

In consideration of those factors, the invention is based on the object of providing an effective system on the basis of the tried-and-tested steep-fire mortar weapon with semi-autonomous (pathfinder mode) or fully autonomous (image processing mode) top-attack against movable hard targets, which without conversion or modification requirements can also be effectively used from the same steep-fire weapon against concrete-reinforced locations without having to involve a development risk with regard to operative components which have not yet been functionally proven.

In accordance with that construction, the same item of ammunition can be effectively used from the same weapon against hard targets with reactive additional armoring and also against concretereinforced or sandbag-fortified protection arrangements, insofar as a high-mass full-caliber hollow charge at the front end thereof serves, on the one hand, for clearing reactive additional armor modules on the main armoring of a hard target and on the other hand for piercing a protective or concrete wall; while the higher-energy, also full-caliber, blast-forming hollow charge which is disposed immediately therebehind penetrates the main amoring of the hard target (but after passing into the protected space behind the pierced concrete wall still produces a secondary blast action); while, on the other hand, the post-firing charge which detonates on the main armoring of the hard target produces a secondary effect against unprotected sensor elements and possibly even clears the reactive additional armoring modules over an even larger area, but in particular after passing through the pierced concrete wall, produces its effect in the space therebehind, as a fragmentforming-explosive projectile.

In that case the post-firing charge can be arranged behind the main hollow charge (cut off in terms of energy) because the main charge has already been fired, in essence, it is no longer causing any problem, when the post-firing charge, due to inertia, starts to move relative to the projectile casing. That rearwardly displaced post-firing charge affords the structural advantage that folding wings or vanes can be caused to move in a sub-caliber starting position into the space between the boring charge and the main charge during the mortar tube firing procedure, before the folding vanes deploy to become wings for increasing the range and maneuverability after leaving the launch tube of the mortar weapon. If, on the other hand, the arrangement has folding vanes which do not move into the structure but which can be caused to bear in the longitudinal direction against the periphery of the projectile casing (see FIGS. 2 and 3 of U.S. Pat. No. 4 522 356, or FIGS. 1 to 4 of U.S. Pat. No 4 664 339), then the sub-caliber post-firing charge can be arranged between the two hollow charges and the space behind the rearward charge, that is, behind the main hollow charge, and can additionally be made available for a control system, for example, in accordance with the disclosure of U.S. Pat. No 5 040 745, for folding rudders, in accordance, for example, the disclosure of with U.S. Pat. No 4 660 786 for controlling the guided missile. However, the post-firing charge must now be provided with a self-destruct detonator and/or the main hollow charge with a delay fuse. That is necessary, on the one hand, so that its high-speed blast, when deliberately used against hard targets, is not affected by the fact that the post-firing charge is still present. On the other hand, when the ammunition is used against concrete, the post-firing charge is not to be caught up by and destroyed by the hollow charge blast before it has passed through the ruptured concrete wall into the space behind the protective wall, and caused to detonate.

BRIEF DESCRIPTION OF THE INVENTION

Additional alternatives and developments as well as further features and advantages of the invention will be apparent from the following description of preferred embodiments of the construction according to the invention which are shown approsimately true to scale but in highly diagrammatic simplified form, being restricted to what is essential. In the drawing:

BRIEF DESCRIPTION OF PREFERRED EMBODIMENTS

Figure 2:
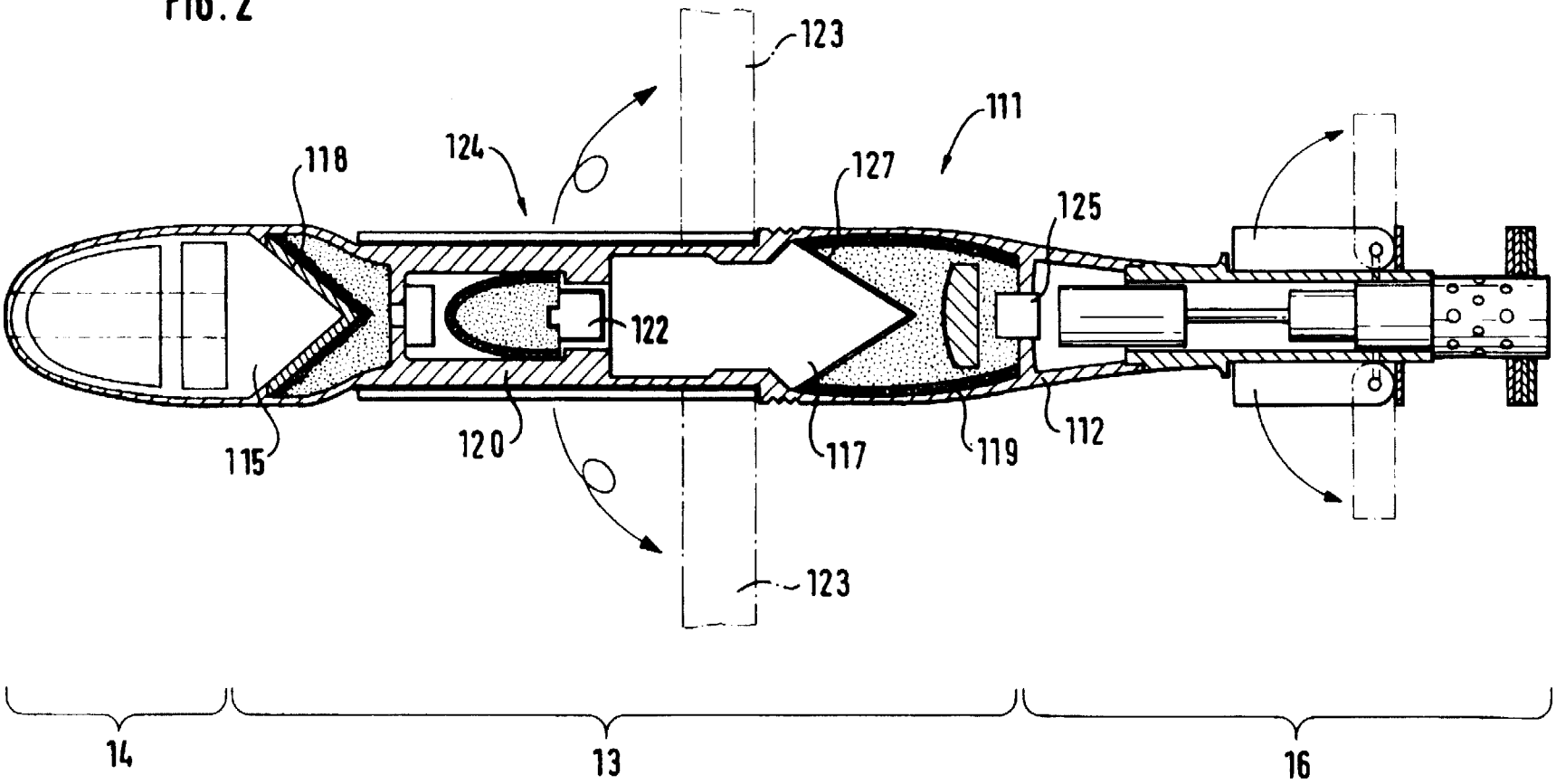

FIG. 1 shows a guided missile according to the invention with folding vanes engaging into its combination warhead, and FIG. 2 shows a more compact arrangement of the combination warhead with externally disposed folding vanes of the guided missile.

The guided missile 11 which can be used autonomously (by means of image processing) or semiautonomously (by means of a target pathfinder) is in the form of a mortar projectile 12 with the bottle-shaped tail 16 which, in respect thereof, is typical for receiving removable partial charges and a tail rudder control system. However, now the projectile is provided with a universal or combination warhead 13 which can be used equally against reactively armored hard targets and also against shelters, in effect, a warhead which is both armor-piercing and also bunker-piercing. Behind a seeking or search head 14 with detection and flight control signal processing means for target seeking or final phase guidance, the warhead 13 has a full-caliber hollow charge 15 with a shallow-cone, that is, a compact blast-forming insert 18. This is primarily designed as a boring or blasting charge for use against concrete. In the event of impact or percussion firing against a hard target, however, it also triggers modules of a reactive additional armoring arrangement, and this occurs with a greater effect than the usual small precursor of conventional tandem warheads. A main hollow charge 17 which is also full-caliber is installed in a position of being displaced axially relative to the front hollow charge 15 in the direction of the tail 16 of the projectile 12. The insert 25 of the main charge 17 is thinner and has a more acute angle than the front insert 18. The blast of the main hollow charge 17, which is faster and lengthier as a result, penetrates the main armoring of the target in the region which had been cleared of reactive modules by the preliminary hollow charge 15. In contrast, the blast from the main hollow charge 17 possibly produces a secondary effect when penetrating into a concrete bunker which has already been blasted open by the preliminary or boring hollow charge 15, but the blast effect of the detonating hollow charge is not a negligible one.

A sub-caliber post-firing charge or second-shot charge 20 for an explosive and fragmentation effect is provided for effect behind a pierced concrete wall. It is initially fixed in force-transmissive relationship in a holder 21. When the projectile 12 is abruptly braked by virtue of impact against the target, the inertial mass of the post-firing charge 20 slides forwardly and out of its holder in order finally to pass through the hole which has been blasted open by the boring hollow charge 15, into the internal space behind the concrete wall before the response of its time-controlled fuse 22. As a result of the firing or fuse system which is disposed centrally between janus-shaped fragmentation-enased operative charges (see DE 39 41 445 A1) that charge 20 also has an effect in an opposite relationship with the penetrating direction and thus also directly behind the penetrated protective wall. If the impact of the projectile 12 is not against concrete but against a hard-armored target object, then the post-firing charge admittedly does not penetrate through the small hole which is burnt into the main armoring by the main hollow charge 17, but detonates on the target object and thus still produces a secondary effect, for example, in relation to unprotected sensor elements.

Arranging the post-firing charge 20 behind the main hollow charge 17 does not cause any problem, inasmuch as the latter has already been fired before the position thereof is reached by the post-firing charge that is propelled by the effect of inertia. If however, contrary to the view shown in FIG. 1, the vanes 123 which are required for the range and the maneuverability of the guided projectile 111 do not have to engage into the interior of the projectile 11 when launched from the mortar tube, but as shown in FIG. 2 can be arranged on the outside peripheral surface thereof, the space which is achieved by virtue of that arrangement in the central region 124 of the projectile 112 can be utilized for installation of the post-firing charge 120 with insert 118 in front of the main hollow charge 117 with insert 127. The main hollow charges are covered by fragmentation casings 19, 119, respectively. That affords the advantage of shorter distance for the charge 120 which is set in motion in the event of impact against the target so that the charge 120 strikes with a correspondingly greater degree of reliability the hole which as been produced in a fortification by the boring hollow charge 115 in order first to detonate in the interior of the fortification, initiated from its delay fuse 122. It will be noted that now it is necessary to ensure by means of a delay fuse 125, in relation to the main hollow charge 117, that the blast development thereof occurs only when the post-firing charge 120 has covered its path through the projectile 112, in dependence on inertia, after impact of the projectile 112; for otherwise the post-firing charge 120 would be damaged by the high-speed blast of the main hollow charge 117 or would even by destroyed by firing thereof, before it reaches the target after the compact blast of the boring hollow charge 115. Otherwise the forwardly disposed post-firing charge 120 must be destroyed by its fuse 122 if a hard target is aimed at, and therefore the blast effect of the main hollow charge 117 should not be interfered with.

I claim:

1. A guided missile consisting of a mortar projectile for crisis reaction forces utilized against varied types of target including concrete shelters and hard-armored vehicles, comprising: a bottle-shaped tail end including a mortar propellant charge; a forward end including a target-seeking head; overcaliber-sized extendable tail end rudders including a control system for guidance towards a target; centrally arranged overcaliber-sized extendable glide vanes for increasing the range of flight of said missile; a forward hollow charge located rearwardly of the seeking head and a boring charge insert for the forming of a compact jet; a main hollow charge including a cutting charge-insert being arranged therebehind for the forming of an extended jet; a holder for a subcaliber-sized secondary-effect follow-up charge which is axially forwardly acceleratable responsive to a delay caused by impact against a target, including a time-delayed fuze for an explosive and fragmentation effect after penetration through a hole formed in a concrete plate by the boring charge insert; wherein the holder for the subcalibersized follow-up charge is arranged rearwardly of the cutting charge-insert.

2. A guided missile consisting of a mortar projectile for crisis reaction forces utilized against varied types of target including concrete shelters and hardarmored vehicles, comprising: a bottle-shaped tail end including a mortar propellant charge; a forward end including a target-seeking head; overcaliber-sized extendable tail end rudders including a control system for guidance towards a target; centrally arranged overcaliber-sized extendable glide vanes for increasing the range of flight of said missile; a forward hollow charge located rearwardly of the seeking head and a boring charge insert for the forming of a compact jet; a main hollow charge including a cutting charge-insert being arranged therebehind for the forming of an extended jet; a holder for a subcaliber-sized secondary-effect follow-up charge which is axially forwardly acceleratable responsive to a delay caused by impact against a target, including a time-delayed fuze for an explosive and fragmentation effect after penetration through a hole formed in a concrete plate by the boring charge insert; wherein the holder for the subcalibersized follow-up charge is arranged in a center region of the missile between the boring charge insert and the cutting charge insert and includes a time-delay and self-destruct fuze.

3. A guided missile as claimed in claim 1, wherein said glide vanes which in the inwardly pivoted condition thereof project to a limited extent into the confines of the projectile.

4. A guided missile as claimed in claim 2, wherein said main hollow charge is equipped with a delay fuze.

5. A guided missile as claimed in claim 2, wherein said time-delay and self-destruct fuzes can be switched on or off depending upon the scenario of use of the missile.

6. A guided missile as claimed in claim 1 or 2, wherein the main hollow charge is covered by a fragmentation casing.

7. A guided missile as claimed in claim 1,or 2, wherein the cutting charge insert of the main hollow charge possesses a more acute angle and is thinner than the insert of the forward hollow charge.

* * * * *